United States Patent [19]

Greenberger et al.

[11] 4,425,928

[45] Jan. 17, 1984

[54] LIQUID DISCHARGE APPARATUS

[75] Inventors: Joseph I. Greenberger, Pittsburgh; Frederick C. Kohring, Houston, both of Pa.

[73] Assignee: Wean United, Inc., Pittsburgh, Pa.

[21] Appl. No.: 312,562

[22] Filed: Oct. 19, 1981

[51] Int. Cl.[3] ..... B08B 3/02

[52] U.S. Cl. ..... 134/122 R; 137/593; 266/113

[58] Field of Search ..... 137/593; 266/113, 114; 134/122 R, 122 P, 199

[56] References Cited

U.S. PATENT DOCUMENTS

| | | | |
|---|---|---|---|
| 1,998,192 | 4/1935 | Haswell | 134/122 R |
| 3,299,900 | 1/1967 | Stone et al. | 134/122 R |
| 4,149,703 | 4/1979 | Safford | 134/199 X |
| 4,367,785 | 1/1983 | Allen | 137/593 X |

*Primary Examiner*—Robert L. Bleutge

*Attorney, Agent, or Firm*—Daniel Patch; Suzanne Kikel

[57] ABSTRACT

A water discharging system for cooling hot rolled steel strip including a header for delivering water to the strip, a water supply system for the header, two fixed overflow pipes arranged to control the volume output of said header: one capable of producing the full flow capacity, and the other a half flow capacity of the water delivered by the header, and a valve for bringing into operation one or the other of said overflow pipes.

12 Claims, 4 Drawing Figures

LIQUID DISCHARGE APPARATUS

BACKGROUND OF THE INVENTION

The present invention relates to an improvement in controlling the quantity of fluid delivered to a header and discharged in turn by the header to an object to be treated by the fluid. While the invention is considered to have a wide range of applications, for the purpose of explanation, it will be discussed as applied to the cooling of hot strip while being rolled or immediately after rolling in a rolling mill.

In the operation of a continuous hot strip rolling mill, and particularly the finishing train thereof, two important considerations are involved as far as the control of the temperature of the strip by removal of heat is concerned. The temperature of a given strip as it immediately leaves the last stand of the finishing train, for metallurgical reasons, must be maintained at a predetermined temperature. Similarly the temperature of a given strip as it reaches the downcoiler, again for metallurgical reasons, must be maintained at a predetermined temperature; howbeit, at a different temperature than the strip finishing temperature. These two fundamental requisites in the past have required that as to the finishing stand temperature, the speed of the finishing train be regulated to assure that the proper temperature was obtained, and as to the downcoiler temperature, the strip, after leaving the last stand of the finishing train was subjected to a controlled application of cooling water above and below the strip.

In more recent hot strip mills, as the demand for greater tonnage, the requirement to roll more difficult products, and need for superior quality were imposed, the strip cooling systems expanded substantially in size and capacity and control sophistication. This has resulted in providing cooling systems which were extremely complicated, expensive and unreliable. For example, in the desire for automation and quick and fine control of the strip temperature, the attendant temperature of the strip produced in the runout cooling system is controlled by a digital feedback computer system in conjunction with literally hundreds of electronic and hydraulic components.

In the past, in a very limited way, fixed hydraulic head overflow pipes have been employed to control the quantity of fluid delivered to the headers of hot strip rolling mill runout cooling systems, but such an approach has never been attempted as an analog control of the volume of the coolant fluid by employing multiple fixed overflow pipes designed to cover the entire temperature requirements of the hot strip mill; nor have they been employed in this context, as interstand cooling units.

SUMMARY OF THE INVENTION

It is, therefore, an object of the present invention to provide an improved liquid discharge apparatus that will produce the required volumetric output with the necessary flexibility and reliability but which will not include a variable flow control, but instead, employes a system giving a full flow or one or more lesser fractional flow rates controlled by an on-off system of control.

It is a still further object of the present invention to provide a water discharge system for cooling hot rolled steel strip including a header for delivering water, a water supply system for the header, two fixed overflow pipes, one capable of producing a full flow volumetric capacity and the other half flow volumetric capacity of the water delivered by the header, and a valve for bringing into operation one or the other of said overflow pipes.

These objects, as well as other novel features and advantages of the present invention, will be better appreciated when the following description of a preferred embodiment is read along with the accompanying drawings of which:

DESCRIPTION OF THE DRAWINGS

With reference to FIGS. 1 and 2, there is illustrated a strip cooling unit for a runout table zone of a hot strip rolling mill, not shown. Several of the horizontally arranged table rollers of the runout zone are shown in phantom at 10. It should be initially appreciated that the runout zone will be made up of a relatively large number of these units which take the form of several horizontally arranged banks of headers. One of the important features of the present invention which will be more fully explained later, reside in the advantage realized by the invention in operating one or more of the banks at 100% of its maximum cooling capacity, and the other header banks at 50% of the maximum cooling capacity, thereby reducing the delta temperature variation of the strip at the downcoiler, not shown, by 50%.

In FIG. 1 there is shown a number of upper strip cooling headers 12 which can be constructed in a well known manner to deliver the necessary quantity (GPM) of coolant to the upper surface to the strip as required by the mill. This particular header is designed to deliver a uniform cross-sectional curtain wall of water from a substantial distance above the strip. As will be noted later on, a similar header system is provided for applying water to the lower surface of the strip. While FIG. 1 only shows a number of upper headers 12, FIG. 2 indicates that the system includes a like number of bottom strip cooling headers, in the showing of input lines 14, the input lines of the top header being indicated at 16.

Figure 1:
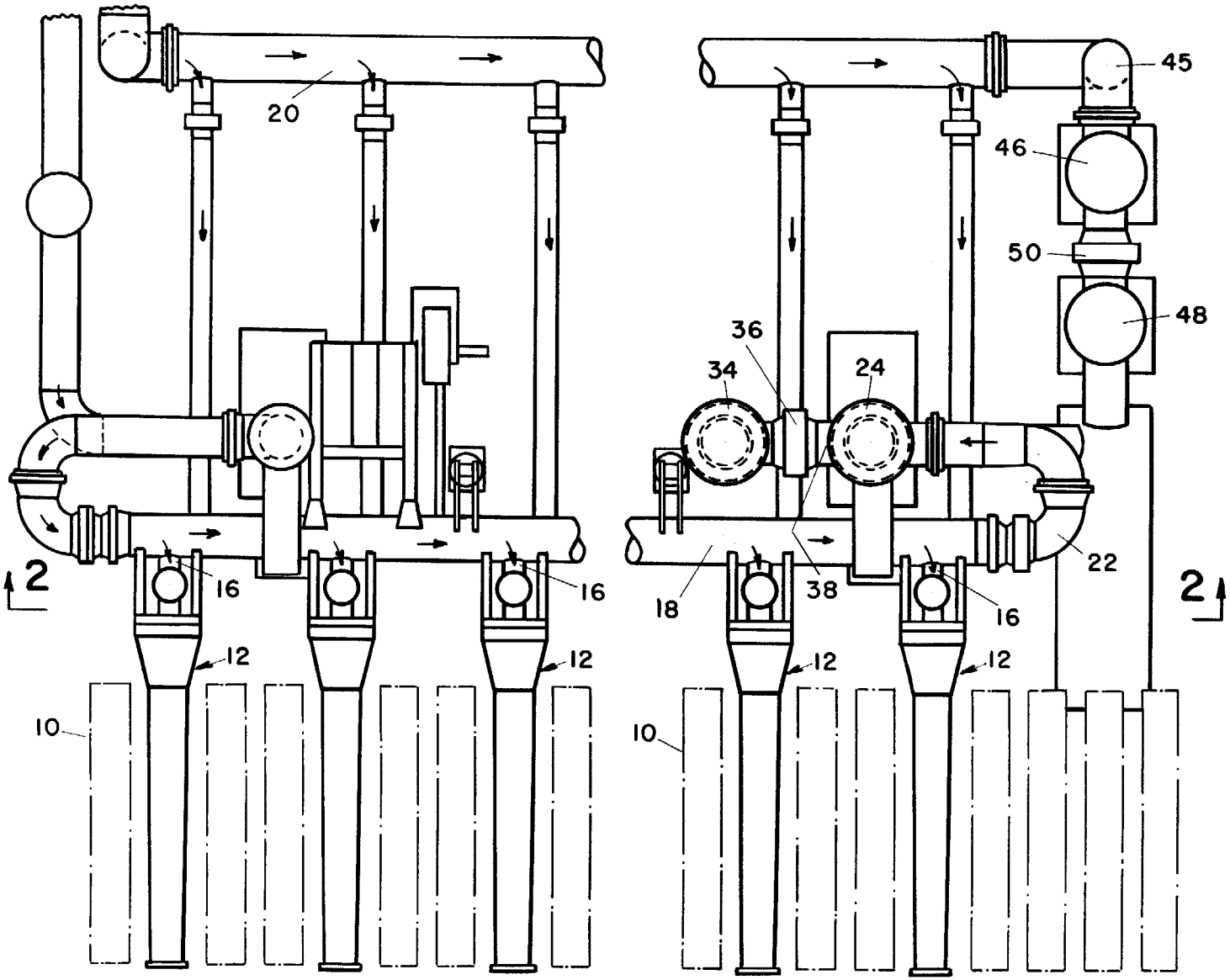
FIG. 1 is a plan view of a multi-overflow pipe strip cooling system provided for the runout section of a hot strip mill in accordance with the teachings of the present invention.
Figure 2:
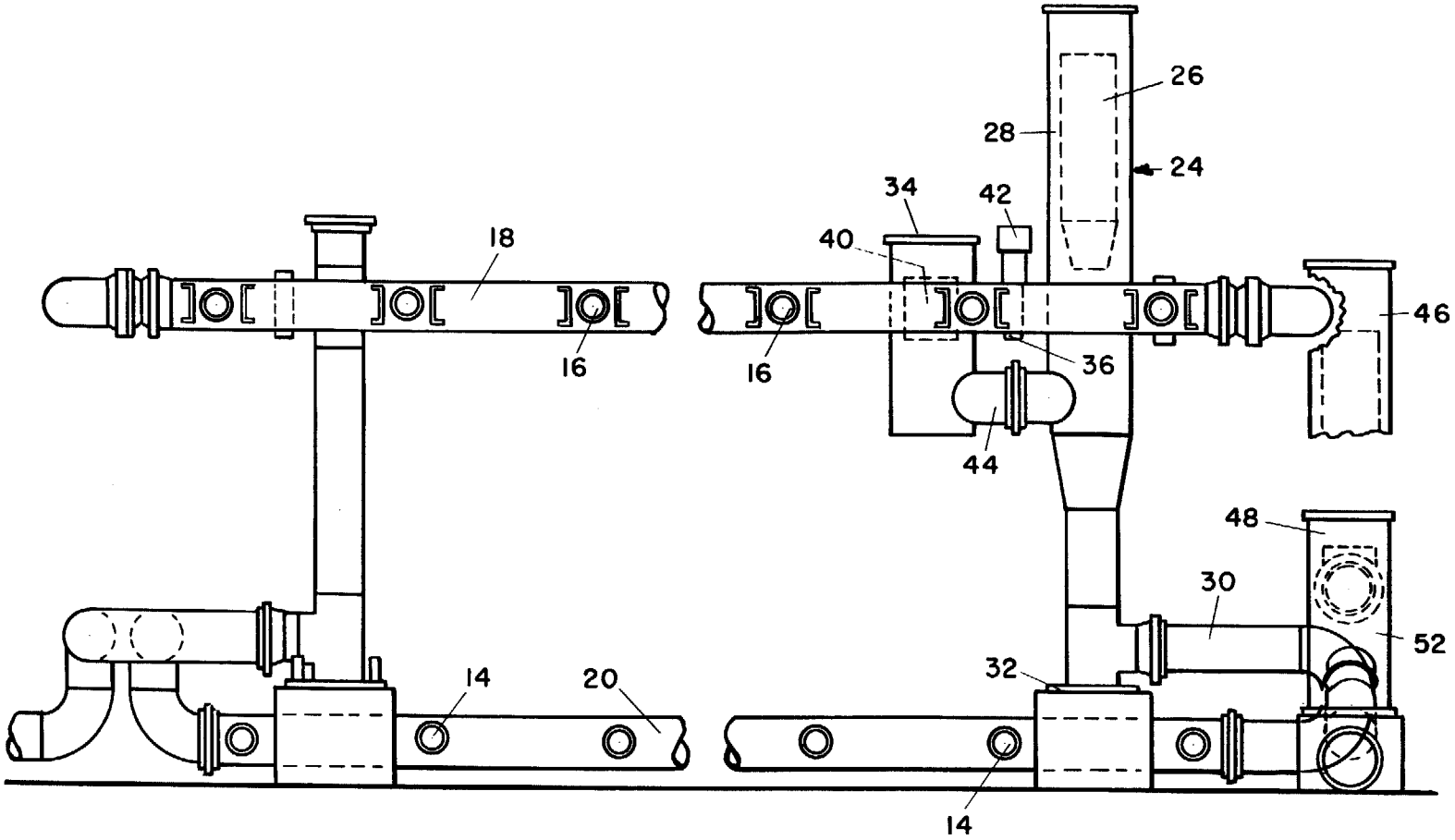
FIG. 2 is an elevational sectional view taken on lines 2—2 of FIG. 1.

Each group or banks of headers are connected to supply manifold 18 and 20, both of which are shown in FIGS. 1 and 2. Addressing ourselves first to the upper strip cooling headers 12 and their supply manifold 18, at the left side as one views FIGS. 1 and 2, the supply manifold 18 is connected to a supply line, not shown, and at the right to an elbow 22 from where the water is fed to two stationary or fixed overflow pipes.

In following the path of the water at this point, reference will be made to FIG. 2. Immediately after the elbow 22, the water enters the first of the two fixedly vertically arranged overflow pipes, namely pipe 24, the effective hydraulic head of which has been designed to provide the required volume (GPM) of water, i.e., 100% of the capacity of the header bank. The overflow pipe 24 has a central cylindrical section 26 into which the water from the manifold 18 enters and which will be filled under certain circumstances until it overflows at the top thereof. When this occurs, the overflowing water will flow around the outside of the cylindrical section 26, but inside the outer section 28 of the overflow pipe 24, and fall to the bottom of the pipe and be conveyed away by drain piping 30. In this area it will be noticed a base 32 is provided to support the overflow pipe 24.

The second fixedly mounted overflow pipe 34 is mounted to the left of the overflow pipe 24 as one views FIG. 2, and is associated with an electrically operated two-way valve 36 mounted in a line 38 that runs between the two overflow pipes 24 and 34. The construction of overflow pipe 34 is generally similar to that of the overflow pipe 24, having a central section 40 into which water is fed and allowed to rise to form an hydraulic head of water at a predictable height determined to be one-half of the hydraulic head of the overflow pipe 24, thus giving a quick and accurate option of delivering water to the headers 12 at 100% or 50% of the maximum GPM capacity of the system. Since the headers 12 are directly connected to the same supply manifold 18 that includes the overflow pipes 24 and 34, the effective hydraulic heads of the two overflow pipes will control the volume of water delivered to and by the headers. The construction and operation of the valve 36 is such that when the valve is closed water will be prevented from passing to the overflow pipe 34, and when open, overflow pipe 34 will receive water so that the water that would pass into overflow pipe 24 will be maintained at the same height or head as the water head of pipe 34.

In FIG. 2 there is shown a part of the electrical control operating mechanism 42 for the valve 36. The drain for the overflow pipe 34 is provided at the bottom of the overflow pipe in the form of a pipe 44, which empties into the drain portion of the overflow pipe 24 as shown in FIG. 2.

In turning now to the volume control water system for the bottom headers, which, as noted, are not shown in the drawings, their supply manifold 20 is led into an elbow 45 at the right of FIG. 1, and into a dual overflow pipe arrangement identical in function and generally similar in construction as the dual overflow pipe arrangement 24 and 34. The overflow pipe 46 most adjacent the elbow 45 as one views FIG. 1 is constructed to serve as the 100% maximum volume capacity unit, and thus is the tallest overflow pipe, while the overflow pipe 48 represents 50% of the maximum volume capacity, or the shorter one, their associated operational valve being indicated at 50. Although not shown in detail, these two overflow pipes will have a drain system similar to the overflow pipes 24 and 34, a portion of the former being shown at 52 in FIG. 2.

In the operation of the described cooling control fluid system, from a temperature control viewpoint it will be appreciated that there can be combinations of 100% flow headers followed finally by 50% flow headers which theoretically will reduce the delta temperature variation of the strip at the downcoiler by 50%. Operationally, the flow through at the bank of headers will be set initially for full flow for all of its headers plus approximately 5% additional flow to always assure a full hydraulic head for all conditions. Once established, this bank flow rate need never be changed or altered. This will permit on-off type of header control which is considerably simplified and more fool-proof than variable flow control systems used previously. The finer potential delta temperature, by use of the half flow or in other cases, if desired, other fractional flow will give far closer temperature controls operationally than is now attainable by present variable flow methods.

Also, it will be appreciated that the present invention can take the form of a header-dual overflow pipe arrangement that can be employed between the stands of the rolling mill wherein one or more headers can be utilized. Moreover, while a dual overflow pipe system has been described above which will give the desired fineness of control for generally all hot strip mill applications presently known, should a still finer degree of control be desirable, additional overflow pipes can be utilized allowing finer degree or smaller fractional control to be obtained.

Figure 3:
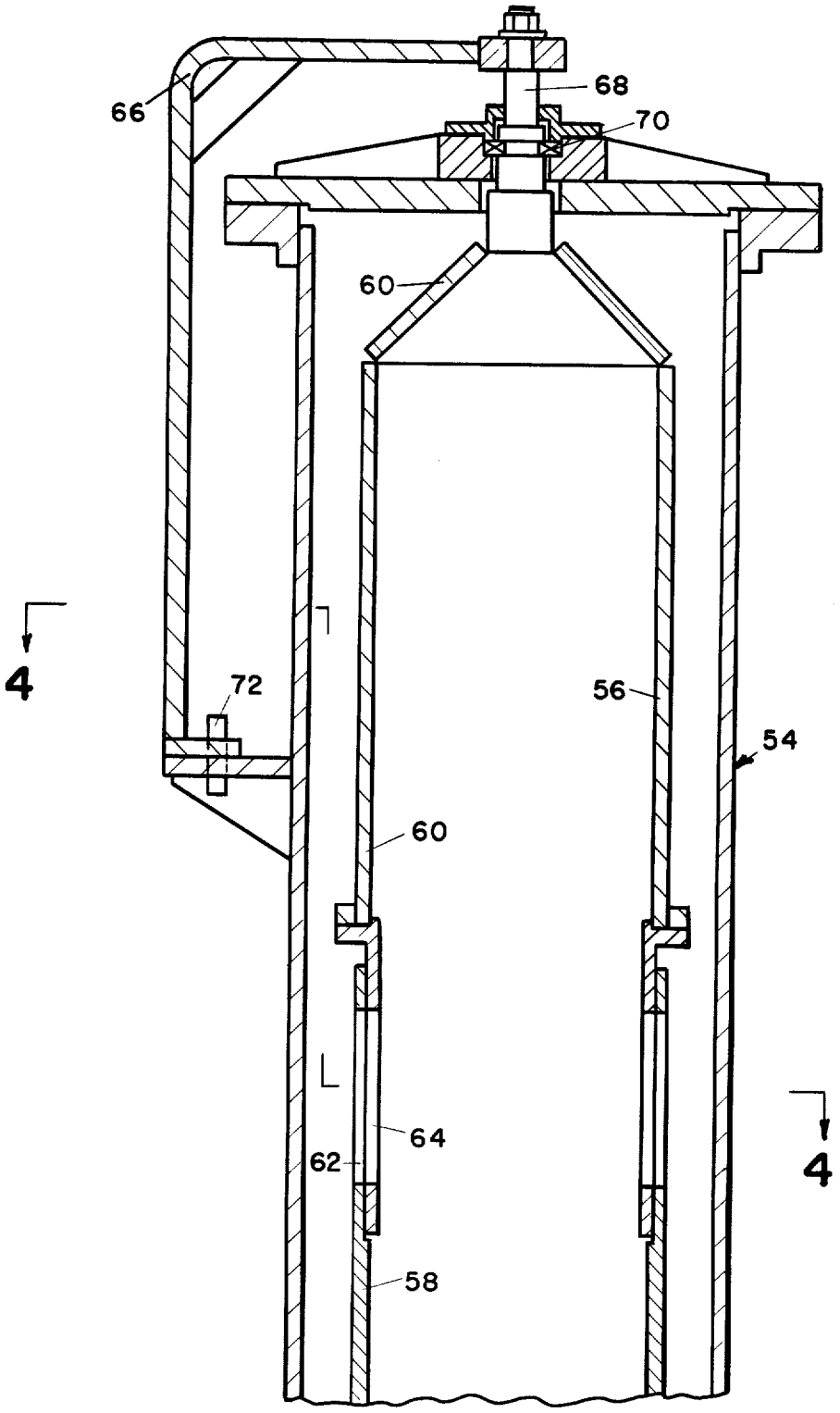
FIG. 3 is an elevational view of a second embodiment of the present invention.
Figure 4:
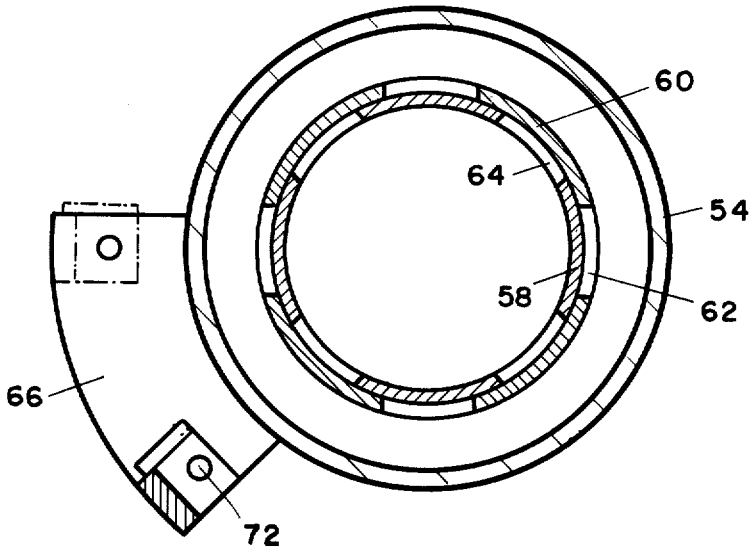
FIG. 4 is a sectional view taken on lines 4—4 of FIG. 3.

FIGS. 3 and 4 illustrate a second embodiment of the present invention. Instead of two separate overflow pipes as utilized in FIGS. 1 and 2, a combined construction can be employed. As illustrated, a portion of overflow pipe 54 is shown having a central cylindrical member 56 which at the top is open to allow water to overflow and return to drain, not shown, between the inside member 54 and the outside of the member 56.

The member 56 at its bottom has a stationary portion 58 which rotatably supports the upper portion thereof 60. Both of these portions 58 and 60 are provided with a series of complementary openings 62 and 64, respectively, which when the openings 64 are rotated to allow the openings to align themselves, water is allowed to overflow at the level of the openings instead of at the top of the portion 60, thus allowing the operational creation of two different hydraulic heights or heads of water in the overflow pipe 54. In FIG. 4 the openings of the portion 60 are shown in their closed position. The portion 60 is rotated by a handle 66 connected to the top of a shaft 68 and a bearing assembly 70, the shaft being integrally connected to the upper portion 60 of the overflow pipe 54.

A locking pin is provided at 72 to maintain the openings 64 in the desired position.

In accordance with the provisions of the patent statutes, we have explained the principle and operation of our invention, and have illustrated and described what we consider to represent the best embodiment thereof.

We claim:

1. A liquid discharge apparatus comprising a discharge header, a liquid volume control means arranged to control the volume output of said header, and including at least two fixedly mounted overflow pipes capable of creating different liquid hydraulic heads, one representing full flow capacity of said header and the other some fraction of said full flow capacity thereof, and means for selectively operating said overflow pipes.

2. An apparatus according to claim 1 wherein said discharge header includes means for producing a uniform curtainwall of cooling liquid for contacting and cooling a hot rolled metallic strip passing relative thereto, said overflow pipes being constructed so that one said hydraulic head represents full flow capacity and said hydraulic head of said second overflow pipe represents half flow capacity of said discharge header.

3. An apparatus according to claim 2 wherein said selecting means includes an electrically controlled valve.

4. An apparatus according to claim 2 wherein a different one of said liquid discharge apparatuses is arranged to apply liquid to the top and bottom surface of said strip as it passes therebetween.

5. An apparatus according to claim 2 wherein said apparatus includes a number of said headers and wherein said liquid volume control means is controlled and arranged to control the liquid output of all said headers.

6. In an apparatus according to claim 2 including means connected to each said overflow pipes for receiving the overflow from said overflow pipes.

7. An apparatus according to claim 3 wherein said valve is controlled and arranged relative to said two overflow pipes so that when in a closed position only said full flow overflow pipe receives liquid and when in its open position only the overflow pipe receives liquid.

8. In an apparatus according to claim 2 wherein said headers comprise a number of headers which are formed into two or more banks of headers and wherein said means for selectively operating said overflow pipes includes means of an on-off type for effecting operation of said banks.

9. An apparatus according to claim 1, wherein said overflow pipes include means for connecting and extending a first pipe above a second pipe and wherein said first pipe cooperates with said second pipe to operatively create the greater hydraulic head and said second pipe operatively creates the lesser hydraulic head.

10. An apparatus according to claim 9, wherein said means for selectively operating said first and second pipes includes valve means arranged between said two pipes constructed in a manner so that when closed, fluid introduced into said second pipe is caused to flow to the top of said first pipe to create said greater hydraulic head, and when in said open position to flow out through said valve to create said lesser hydraulic head.

11. An apparatus according to claim 10, wherein said first pipe is rotatable relative to said second pipe, and wherein said valve means comprises a non-rotatable first section connected to said second pipe and a rotatable second section connected to said first pipe, said sections having cooperating openings for allowing fluid to flow from said two overflow pipes when said openings are in alignment with each other, and means for rotating said first pipe and said rotatable section to bring said openings into and out of alignment thereby opening and closing respectively said valve means.

12. An apparatus according to claim 11, further comprising:

an external pipe concentrically arranged away from said two arranged overflow pipes creating a passageway therebetween, and wherein when said selective hydraulic heads are created, said fluid from said overflow pipes flows down into said passageway from where it is drained.

* * * * *